US005353733A

United States Patent [19]

Evans

[11] Patent Number: 5,353,733

[45] Date of Patent: Oct. 11, 1994

[54] FOLDING BOAT WITH DETACHABLE LAND WHEELS

[76] Inventor: Forrest B. Evans, 13171 W. Florida Dr., Lakewood, Colo. 80228

[21] Appl. No.: 43,405

[22] Filed: Apr. 6, 1993

[51] Int. Cl.[5] ..... B63B 7/00

[52] U.S. Cl. ..... 114/353; 114/61; 114/123

[58] Field of Search ..... 114/343, 352, 353, 344, 114/357, 123, 39.1, 362, 61

[56] References Cited

U.S. PATENT DOCUMENTS

| | | | |
|---|---|---|---|
| 1,899,900 | 2/1933 | Nelson | 114/353 |
| 3,090,973 | 5/1963 | Levinson | 114/353 |
| 3,135,975 | 6/1964 | Andranigian | 114/344 |
| 3,738,684 | 6/1973 | Lusk | 114/344 |
| 4,616,591 | 10/1986 | Minor | 114/347 |

FOREIGN PATENT DOCUMENTS

| | | | |
|---|---|---|---|
| 1568653 | 6/1980 | United Kingdom | 114/343 |

*Primary Examiner*—Edwin L. Swinehart

[57] ABSTRACT

A folding boat is comprised of a bow section having a bottom, first and second side walls joined to the bottom and upstanding to respective first and second gunwales. The side walls terminate at a forward end forming a prow and the bottom and side walls are joined to a bow section bulkhead at an aft end and having a thwart connecting the side wall gunwales. A stem section has a bottom including a keel, first and second side walls joined to the bottom and upstanding to respective first and second gunwales. The side walls terminate at a stern end and the bottom and side walls join to a bulkhead at a forward end of the stern section and having a thwart connecting the side wall gunwales. A hinge extends across thwarts, permitting the stem section to be folded with respect to the bow section, whereby the respective gunwales are juxtaposed and which may be unfolded again to an extended configuration wherein the respective bow section and stern section gunwales and keels are contiguously aligned. An axle supporting a pair of wheels fastens to the bow section aft bulkhead with the boat in the folded configuration and a tow bar fastens to the prow, whereby the folded boat may be towed manually or with a vehicle. In preferred embodiments a transverse channel between the bow and stem section bulkheads retains a first beam and the stem gunwales retain a second beam capable of supporting parallel outriggers or parallel boats in a catamaran configuration.

17 Claims, 4 Drawing Sheets

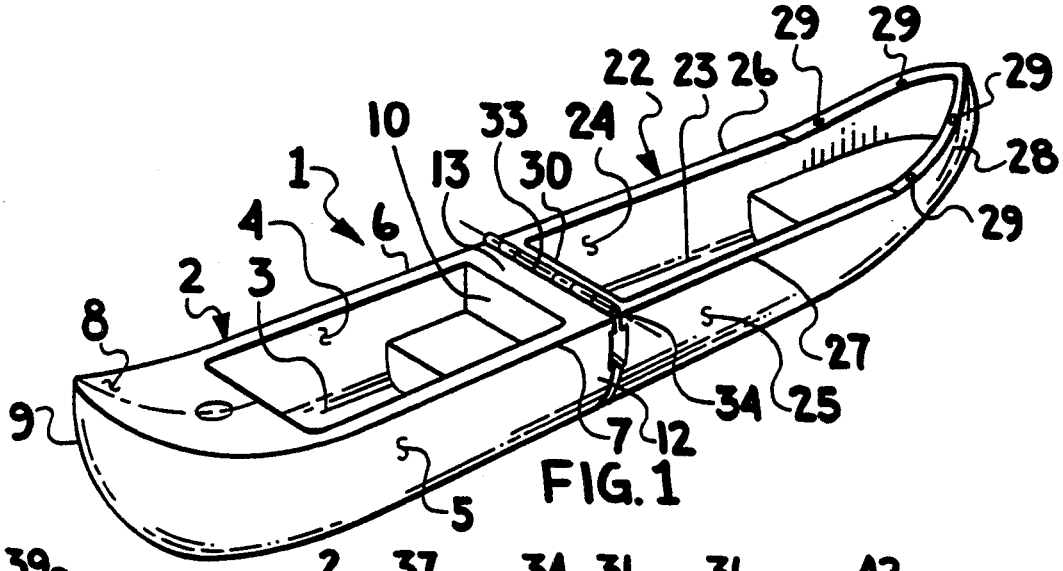
FIG. 1
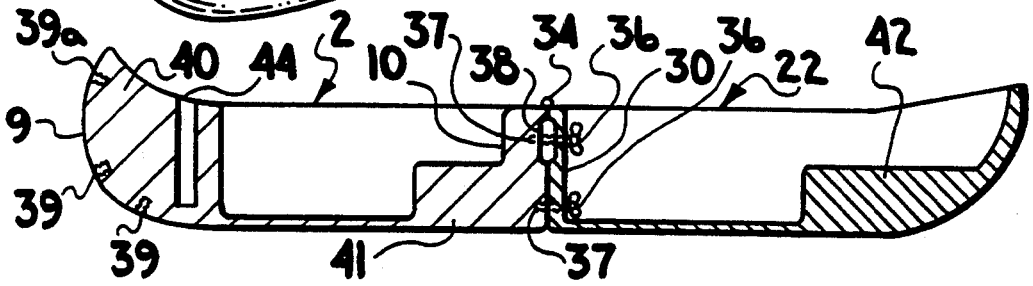
FIG. 2
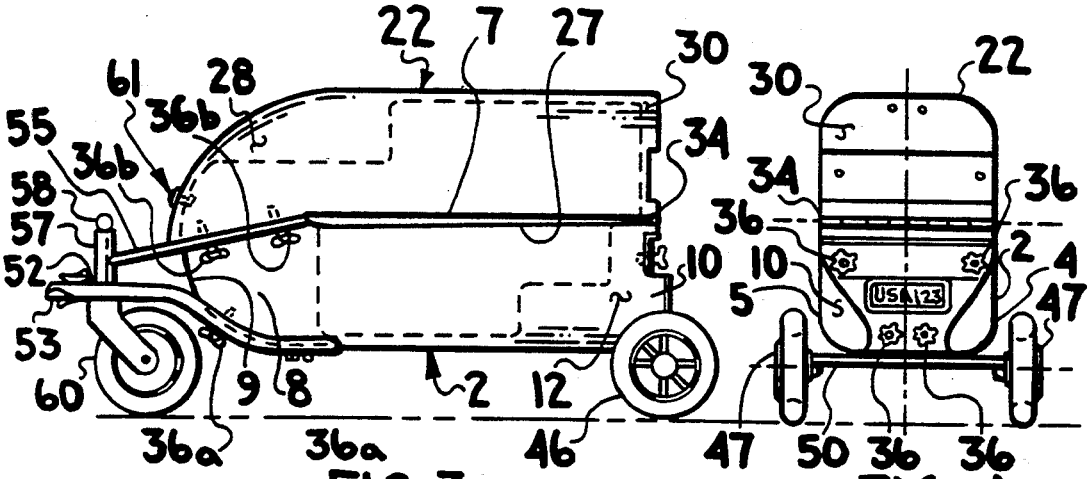
FIG. 3
FIG. 4

FOLDING BOAT WITH DETACHABLE LAND WHEELS

BACKGROUND OF THE INVENTION

This invention pertains to folding boats which employ a means of hinging hull sections one above the other, and more particularly to folding boats with wheels for both towing by a vehicle and manual portage between bodies of water. There are many patents in the prior an for folding boats with wheels, but none of them provide for both vehicular towing and manual portage. One such patent is U.S. Pat. No. 2,157,186, J. Pinter, Sr. et al. This patent discloses a folding boat with a single swivel wheel which cannot be used on the bumpers of late model vehicles, and which would be very unstable and clumsy for portage. The Levinson U.S. Pat. No. 3,090,973 and Speranya U.S. Pat. No. 4,180,881 show a single trailer hitch which is adaptable to current automobiles, but use springs, wheels, tow-bar assembly and frame added to the boat, increasing the weight and precluding the portage. The Cunningham U.S. Pat. No. 4,936,595 shows practical portage wheels, but no means for towing. Holzbaur U.S. Pat. No. 4,522,143 teaches retractable wheels for a folding boat that is towable, and launchable, but not intended for portage.

BRIEF SUMMARY OF THE INVENTION

The present invention eliminates the disadvantages of prior-art devices by providing a simple, lightweight folding boat that has a pair of detachable wheels that are adapted either towing or portage, and a detachable tow hitch that permits towing by a small car; which, with the attachment of a pivoting caster wheel, provides a stable and lightweight 3-wheeled portage configuration. The tow hitch and wheels are small enough to be stowed in the boat while traveling on water, so they are available for portage when needed. The present invention boat is provides a number of configurations. An outrigger for use in windy and rough water also meets the primary requirement of being light and small enough to store in the boat on land or water. The outrigger structural supports permit the use of dual outriggers in a trimaran configuration, or even a dual hulled catamaran suitable for sail may be configured. An inexpensive, light and efficient outboard motor mount also is attachable to any of the boat configurations provided by the invention.

BRIEF DESCRIPTION OF THE DRAWINGS

FIG. 1 perspective view of a folding boat according to the present invention, shown in the unfolded configuration;

FIG. 2 is a side-elevation cross-sectional view of the boat of FIG. 1, taken along the centerline;

FIG. 3 is a side-elevation cross-sectional view of the boat of FIG. 1, shown in the folded configuration for towing or portage;

FIG. 4 is a rear-elevation view of the boat of FIG. 2;

DETAILED DESCRIPTION OF THE DRAWINGS

Figure 5:
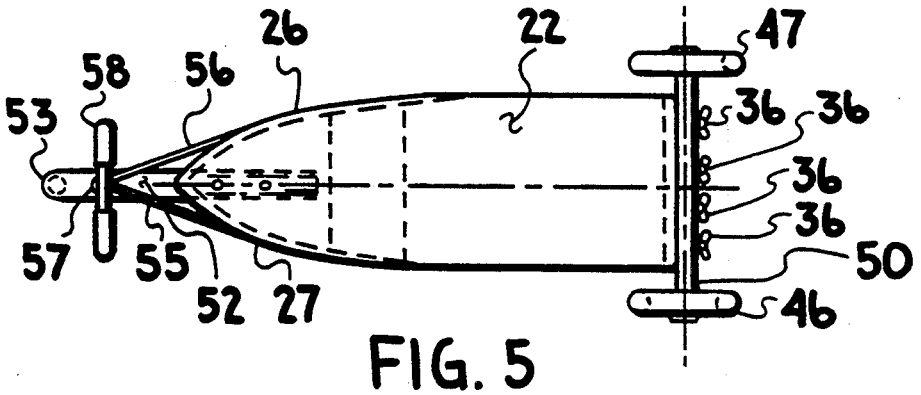
FIG. 5 is a top plan view of the boat of FIG. 2 and 3.

In FIG. 1 the boat 1 according to the invention is shown including a bow section 2 having a bottom, first and second side walls 4 and 5 joined to bottom 3 and upstanding to respective first and second gunwales 6 and 7, The side walls 4 and 5 terminate at a forward end 8 end forming a prow 9. Bottom 3 and side walls 4 and 5 join to an upstanding transverse bow section bulkhead 10 at an aft end 12 and having a thwart 13 connecting side wall gunwales 4 and 5.

Stern section 22 has a bottom including a keel, first and second side walls joined to said bottom 23 and upstanding to respective first and second side walls 24 and 25 upstanding to first and second gunwales 26 and 27. Side walls 24 and 25 terminate at a stern end 28 and bottom 23 and side walls 24 and 25 are joined to a transverse stern section bulkhead 30 at a forward end 31 of stern section 22 and having a thwart 33 connecting side wall gunwales 26 and 27. A hinge 34 extends across and hingedly attaches the thwarts 13 and 33 of the bow section bulkhead 10 and the stern section bulkhead 30, permitting the stern section 22 to be folded with respect to the bow section 2, whereby the respective gunwales 6,26 and 7, 27 are juxtaposed and which may be unfolded again to the extended configuration wherein the respective bow section gunwales 6 and 7 are contiguously aligned with stern section gunwales and 27.

In FIG. 2 bow section 2 and stem section 22 are shown hingedly joined by hinge 34, and held in the extended or unfolded configuration by screw fasteners 36 sealed, but rotatable in bulkhead 30 and threaded into threads 37 in bulkhead 10. Bulkheads 10 and 30 cooperate to form a transverse channel 38. Bow section 2 and stem section 22 are illustrated with integral flotation seats 40, 41 and 42, typical of foam-filled double-wall construction of many boats. The foam flotation material may be within a skin structure of thermoplastic, fiberglass or aluminum, as the market needs may dictate. A mast socket 44 is shown, which may be used for either lights or a sail. Threaded inserts 29 are shown embedded into prow 9.

In FIGS. 3 and 4 boat 1 according to the invention is shown including: a bow section 2 having forward end 8 and forming a prow 9 and bow section bulkhead 10 at an aft end 12. Bow section gunwale 7 is shown juxtaposed over stern section gunwale 27 as the boat 1 is folded about hinge 34 for towing or portage. Wheels 46 and 47 outboard of each side wall 4 and 5 have fastening means 26 securing axle structure 50 to bow section aft bulkhead 10 with the boat in the folded configuration. The four threaded fasteners 36 shown are the same fasteners 36 of FIG. 2, engaging into threads 37 in bow section bulkhead 10.

In FIG. 3 and 5 a tow bar 52 including a trailer ball socket 53 extends from the prow 9, having fasteners **36*a* securing the tow bar to threaded inserts 39. Struts 55 and 56 are attached to a vertical tube 57 and to stern section gunwales 26 and 27 by fasteners 36*b* threading into threads 29 (shown in FIG. 1). A castered wheel 68 is pivotally attached in tube 57, whereby the folded boat may be manually pulled by handle 57 during portage. When tow bar 52 is used on a vehicle, wheel 68 is removed. A key-operated screw lock 67 is attached to stem end 28, which threads into a threaded insert 39***a* (shown in FIG. 2) in order to lock the boat sections together for secure storage.

Figure 6:
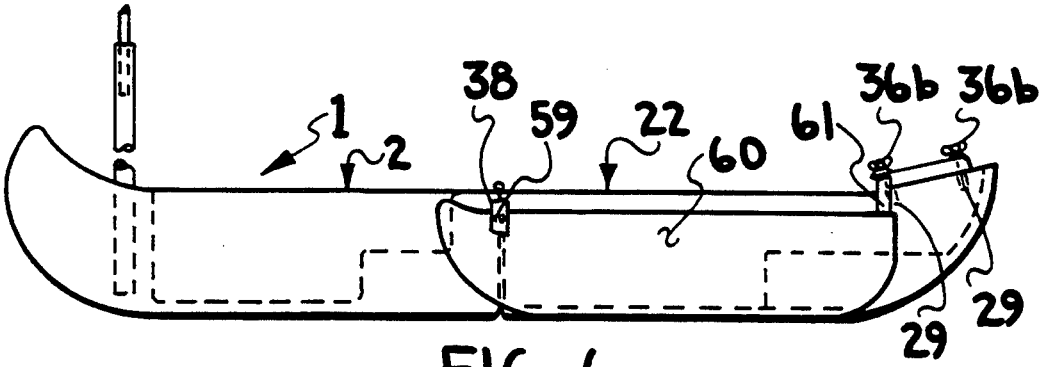
FIG. 6 is a side-elevation view of a preferred embodiment boat of the invention, showing an outrigger float.
Figure 7:
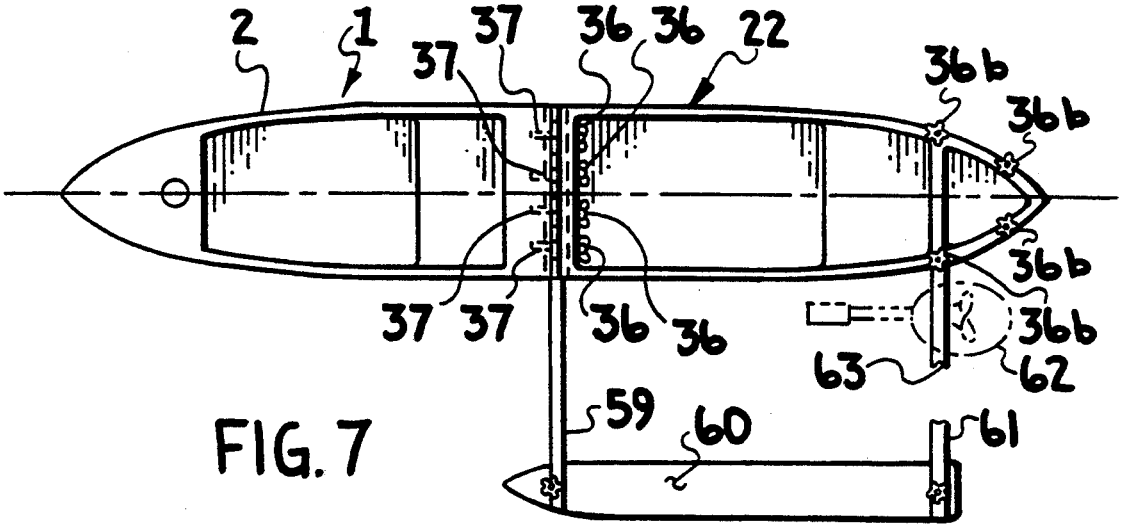
FIG. 7 is a top plan view of the boat of FIG. 6.

In FIGS. 6 and 7 folding boat 1 includes a first, rigid transverse cantilever beam 59 is disposed in the transverse channel 38 (shown in FIGS. 1 and 2) between bulkheads 10 and 30 when the boat is in the extended configuration. Beam 59 is retained in channel 38 by screw fasteners 36 passing through bulkhead 10, beam 59 and into threaded inserts 37 in bulkhead 30. Beam 59 supports an outrigger float 60, which is spaced from and parallel to stem section 22. Outrigger float 60 is additionally supported parallel to the boat by a second rigid transverse, aft cantilever beam 61 attached to the stem section with threaded fasteners 36*b* (shown in FIG. 3) engaged into to threaded holes 29 (shown in FIG. 1) in the stem section gunwales. Optionally an outboard motor 62 (shown in phantom) may be attached conventionally to beam 61*a*. Also beam 61*a* may be shortened to point 63 if it is desired to utilize an outboard motor on boat 1 without using beam 59 or outrigger float 60.

Figure 8:
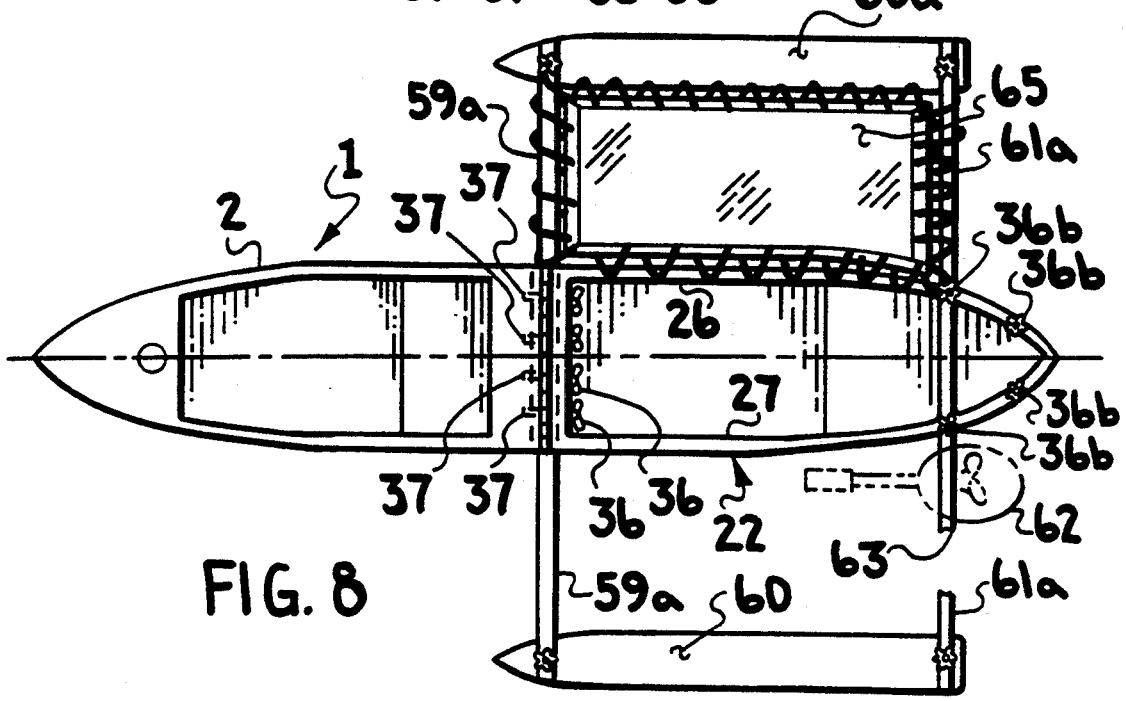
FIG. 8 is a top plan view of a preferred boat of the invention, showing a trimaran configuration.

In FIG. 8 a top plan view of a preferred boat of the invention shows a trimaran configuration in which beam 59*a* extends outward on both sides and additionally supports a second outrigger float 60*a*, which is further supported by a second rigid transverse, double-ended, aft cantilever beam 61*a* attached to the stem section with threaded fasteners 36*b*. In a preferred embodiment fabric panels 65 may be attached to gunwales 26 and 27, the first rigid transverse cantilever beam 59*a*, the second rigid transverse cantilever beam 61*a* and outriggers 60 and 60*a*, forming a passenger-supporting platform.

Figure 9:
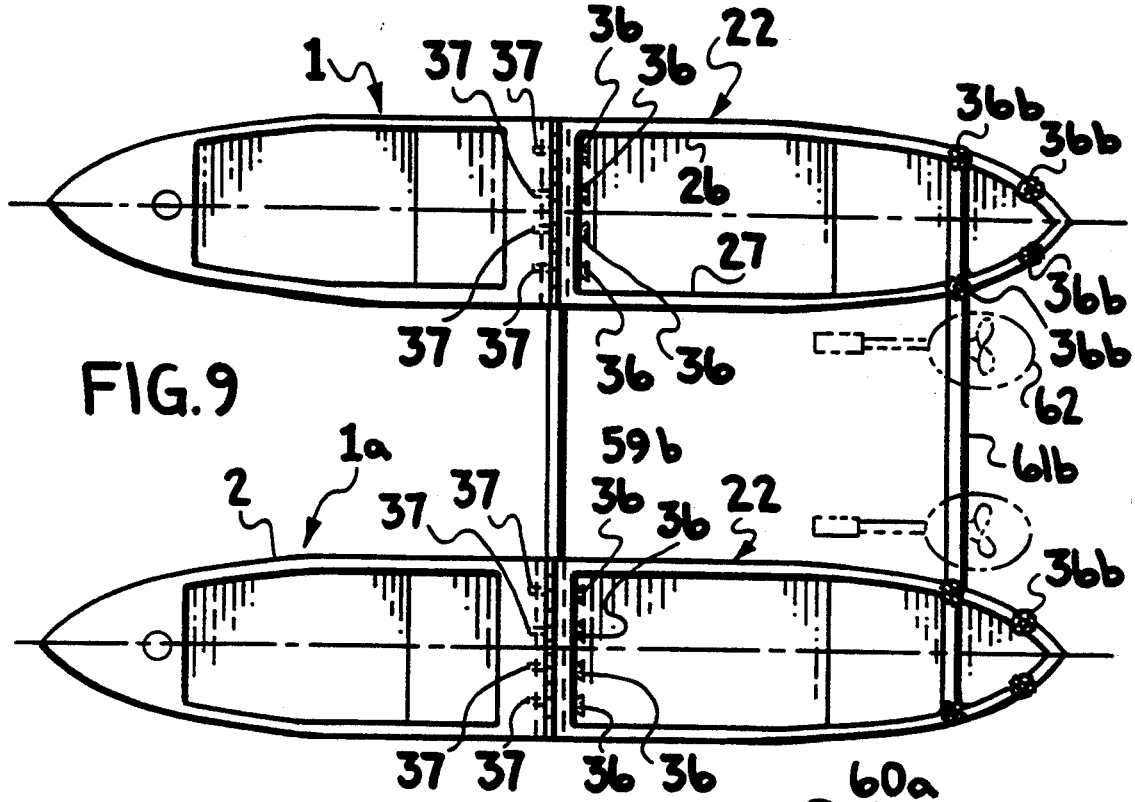
FIG. 9 is a top plan view of a preferred boat of the invention, showing a catamaran configuration.

In FIG. 9 a top plan view of a preferred boat of the invention is shown, showing a catamaran configuration in which a first folding boat second, identical, folding boat la functioning as an outrigger float much in the manner shown in FIG. 7. Folding boats 1 and 1*a* both support rigid transverse cantilever beam 59*b* in transverse channels 38 and 38*a* between the respective bow and stem section bulkheads when both boats are in their extended configurations, beam 59*b* being retained the respective channels by screw fasteners 36 through the respective bulkheads 10, 30 and 10*a*, 30*a*, wherein boats 1 and 1*a* are further mutually supported in a parallel configuration by second rigid transverse cantilever beam 61*b* attached to the respective stem sections with threaded fasteners 36*b* engaged into to threaded holes 29 in the respective boat stem section gunwales. In a preferred embodiment a fabric panel 67 may be attached to gunwale 26 of boat 1 and gunwale 27*a* of boat 1*a*, the first rigid transverse cantilever beam 59*b*, the second rigid transverse cantilever beam 61*b*, forming a passenger-supporting platform.

Figure 10:
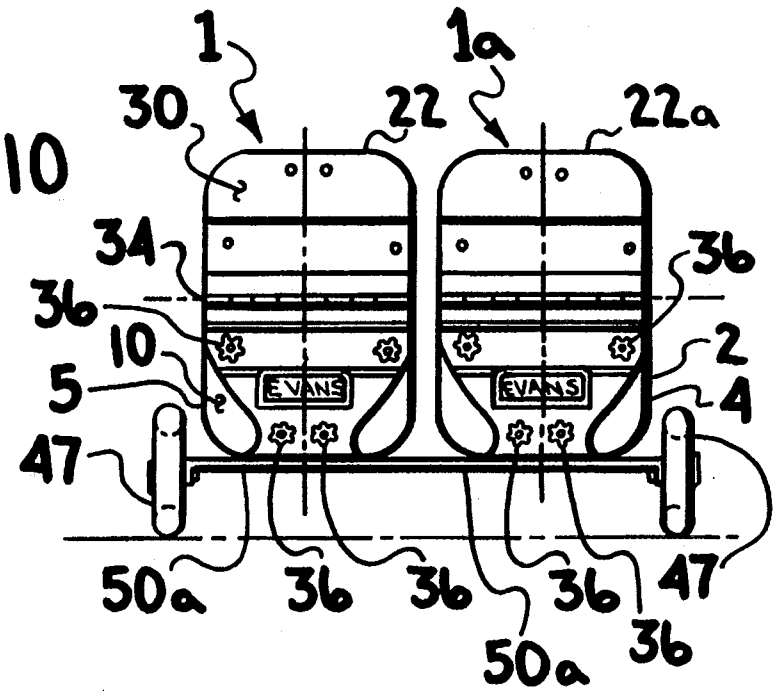
FIG. 10 is a rear-elevation view of the boat of FIG. 9, shown in the folded configuration for towing or portage.

In FIG. 10 a rear-elevation view of the catamaran boat of FIG. 9 is shown in the folded configuration for towing or portage, in which boat 1 and 1*a* are supported by axle structure 50*a* and attached thereto by screw fasteners 36.

Figure 11:
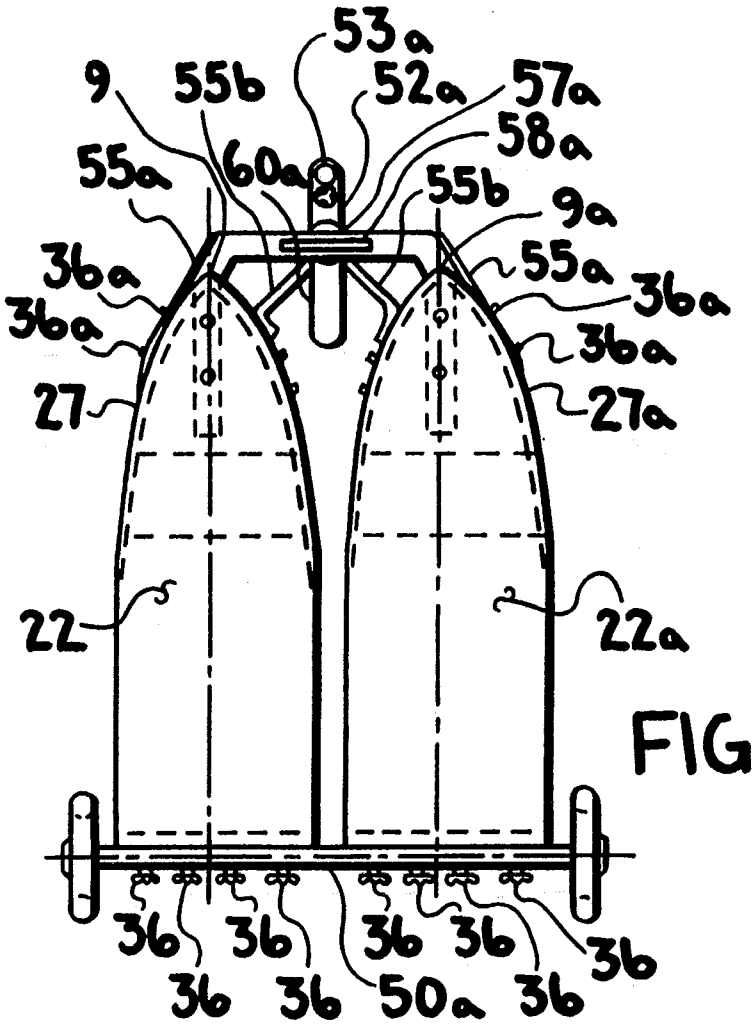
FIG. 11 is a top plan view of the boat of FIG. 10.

In FIG. 11 a top plan view of the boat of FIG. 10 is shown having a a tow bar 52*a* including a trailer ball socket 53*a* extends from the prows 9 and 9*a*, having fasteners 36*a* securing the tow bar to threaded inserts 39. Struts 55, 56 and 55*a*,56*a* are attached to a vertical tube 57*a* and to stem section gunwales 26, 27 and 26*a*, 27*a* by fasteners 36*b* threading into threads 29 (shown in FIG. 5). A castered wheel 68 is pivotally attached in tube 57*a*, whereby the folded boat may be manually pulled by handle 57*a*. When tow bar 58*a* is used on a vehicle, wheel 68 is removed.

The above-described invention overcomes the disadvantages of prior-art devices by providing a simple, lightweight folding boat that permits towing by a small car and provides stable 3-wheeled portage. The tow hitch and wheels are small enough to be stowed in the boat while traveling on water, so they are available for portage when needed. The present invention boat is provides a number of configurations. Although a canoe design is shown for illustration, it is obvious that the principles and structures shown apply to other boat designs to provide similar advantages over prior art folding boats.

I claim:

1. A folding boat comprising:

a bow section having a bottom, first and second side walls joined to said bottom including a keel and upstanding to respective first and second gunwales, said side walls terminating at a forward end forming an upward-curving prow and said bottom and side walls joined to an upstanding transverse bow section bulkhead at an aft end and having a thwart connecting the side wall gunwales;

a stern section having a bottom including a keel, first and second side walls joined to said bottom and upstanding to respective first and second gunwales, said side walls terminating at an upward-curving stern end and said bottom and side walls joined to a transverse stern section bulkhead at a forward end of said stern section and having a thwart connecting the side wall gunwales;

a hinge extending across and hingedly attaching the thwarts of the bow section bulkhead and the stern section bulkhead, permitting the stern section to be folded with respect to the bow section, whereby the respective gunwales are juxtaposed and which may be unfolded again to an extended configuration wherein the respective bow section and stern section gunwales and keels are contiguously aligned;

fastening means for rigidly fastening the bow section to the stern section with the bow and stern sections in contiguous alignment;

an axle parallel to the hinge and supporting a pair of ground-engaging wheels outboard of each side wall and employing the fastening means for rigidly fastening the bow section to the stern section as fastening means of the axle to the bow section aft bulkhead with the boat in the folded configuration; and a tow bar extending from the prow and having fastening means thereto, whereby the folded boat may be towed manually or with a vehicle.

2. A folding boat according to claim 1 in which the tow bar includes a ground-engaging pivotally-mounted wheel having means for attachment to the tow bar.

3. A folding boat according to claim 1 in which the tow bar includes a ground-engaging pivotally-mounted wheel having means for attachmnt to the tow bar and said tow bar also includes a transverse handle for manual portage of the boat.

4. A folding boat according to claim 1 in which the tow bar fastening means comprises a channel member engageable with and fastenable to the bow section keel and prow.

5. A folding boat according to claim 1 in which the tow bar fastening means comprises a channel member engageable with and fastenable to the bow section keel and prow and further comprises a pair of rigid struts attached to the threaded fasteners engaged into threaded holes in the stern section gunwales, when the boat is in the folded configuration.

6. A folding boat according to claim 1 in which the bow section has fastening means for locking to the interior volume within a folded configuration wherein the stern section is folded with respect to the bow section is a secure compartment.

7. A folding boat according to claim 1 in which the fastening means for rigidly fastening the bow section to the stern section with the bow and stern sections in contiguous alignment comprises a plurality of screw fasteners sealably rotatable in the transverse bulkhead of one section of the boat and threaded into the transverse bulkhead of the other section of the boat.

8. A folding boat according to claim 1 in which the bow section bulkhead and the stern section bulkhead form a transverse channel between said bulkheads and side walls when the boat is in the extended configuration.

9. A folding boat according to claim 1 in which the rigid transverse beam is attached to the stern section with threaded fasteners engaged into threaded holes in the respective stern section and is adapted to support an outboard motor.

10. A folding boat comprising:

a bow section having a bottom, first and second side walls joined to said bottom and upstanding to respective first and second gunwales, said side walls terminating at a forward end forming a prow and said bottom and side walls joined to an upstanding transverse bow section bulkhead at an aft end and having a thwart connecting the side wall gunwales;

a stern section having a bottom including a keel, first and second side walls joined to said bottom and upstanding to respective first and second gunwales, said side walls terminating at a stern end and said bottom and side walls joined to a transverse stern section bulkhead at a forward end of said stern section and having a thwart connecting the side wall gunwales;

a hinge extending across and hingedly attaching the thwarts of the bow section bulkhead and the stern section bulkhead, permitting the stern section to be folded with respect to the bow section, whereby the respective gunwales are juxtaposed and which may be unfolded again to an extended configuration wherein the respective bow section and stern section gunwales and keels are contiguously aligned; fastening means for rigidly fastening the bow section to the stern section with the bow and stern sections in contiguous alignment;

an axle parallel to the hinge and supporting a pair of ground-engaging wheels outboard of each side wall and having fastening means to the bow section aft bulkhead with the boat in the folded configuration; and a tow bar extending from the prow and having fastening means thereto, whereby the folded boat may be towed manually or with a vehicle;

wherein the bow section bulkhead and the stern section bulkhead form a transverse channel between said bulkheads when the boat is in the extended conficuration; and wherein a rigid transverse cantelever beam supporting an outrigger float is disposed in the transverse channel between said bulkheads when the boat is in the extended configuration, said beam being retained in said channel by screw fasteners through said bulkheads.

11. A folding boat according to claim 10 in which an outrigger float is additionally supported parallel to the boat by a second rigid transverse beam attached to the stern section with threaded fasteners engaged into threaded holes in the stern section the gunwales.

12. A folding boat according to claim 11 in which a fabric panel between the gunwale and the outrigger is attached to the first rigid transverse cantelever beam, the second rigid transverse cantelever beam, the outrigger and the gunwale between the first and second rigid transverse cantelever beams, said fabric panel forming a passenger-supporting platform.

13. A folding boat comprising:

a bow section having a bottom, first and second side walls joined to said bottom and upstanding to respective first and second gunwales, said side walls terminating at a forward end forming a prow and said bottom and side walls joined to an upstanding transverse bow section bulkhead at an aft end and having a thwart connecting the side wall gunwales;

a stern section having a bottom including a keel, first and second side walls joined to said bottom and upstanding to respective first and second gunwales, said side walls terminating at a stern end and said bottom and side walls joined to a transverse stern section bulkhead at a forward end of said stern section and having a thwart connecting the side wall gunwales;

a hinge extending across and hingedly attaching the thwarts of the bow section bulkhead and the stern section bulkhead, permitting the stern section to be folded with respect to the bow section, whereby the respective gunwales are juxtaposed and which may be unfolded again to an extended configuration wherein the respective bow section and stern section gunwales and keels are contiguously aligned; fastening means for rigidly fastening the bow section to the stern section with the bow and stern sections in contiguous alignment;

an axle parallel to the hinge and supporting a pair of ground-engaging wheels outboard of each side wall and having fastening means to the bow section aft bulkhead with the boat in the folded configuration; and a tow bard extending from the prow and having fastening means thereto, whereby the folded boat may be towed manually or with a vehicle;

wherein the bow section bulkhead and the stern section bulkhead form a transverse channel between said bulkheads when the boat is in the extended conficuration; and wherein a first, rigid transverse cantelever beam supporting a pair of outrigger floats in a trimaran configuration is disposed in the transverse channel between said bulkheads when the boat is in the extended configuration, said beam being retained in said channel by screw fasteners through the bulkheads.

14. A folding boat according to claim 13 in which the outrigger floats are additionally supported parallel to the boat by a second rigid transverse beam attached to the stern section with threaded fasteners engaged into threaded holes in the stern section gunwales.

15. A folding boat according to claim 14 in which a fabric panel between the respective gunwale and outrigger is attached to the first rigid transverse cantelever beam, the second rigid transverse cantelever beam, either outrigger and the respective gunwale between the first and second rigid transverse cantelever beams, said fabric panel forming a passenger-supporting platform.

16. A folding boat comprising:

a bow section having a bottom, first and second side walls joined to said bottom and upstanding to respective first and second gunwales, said side walls terminating at a forward end forming a prow and said bottom and side walls joined to an upstanding transverse bow section bulkhead at an aft end and having a thwart connecting the side wall gunwales;

a stern section having a bottom including a keel, first and second side walls joined to said bottom and upstanding to respective first and second gunwales, said side walls terminating at a stern end and said bottom and side walls joined to a transverse stern section bulkhead at a forward end of said stern section and having a thwart connecting the side wall gunwales;

a hinge extending across and hingedly attaching the thwarts of the bow section bulkhead and the stern section bulkhead, permitting the stern section to be folded with respect to the bow section, whereby the respective gunwales are juxtaposed and which may be unfolded again to an extended configuration wherein the respective bow section and stern section gunwales and keels are contiguously aligned; fastening means for rigidly fastening the bow section to the stern section with the bow and stern sections in contiguous alignment;

an axle parallel to the hinge and supporting a pair of ground-engaging wheels outboard of each side wall and having fastening means to the bow section aft bulkhead with the boat in the folded configuration; and a tow bar extending from the prow and having fastening means thereto, whereby the folded boat may be towed manually or with a vehicle;

wherein the bow section bulkhead and the stern section bulkhead form a transverse channel between said bulkheads when the boat is in the extended conficuration;

wherein a rigid transverse cantelever beam supporting an outrigger float is disposed in the transverse channel between said bulkheads when the boat is in the extended configuration, said beam being retained in said channel by screw fasteners through said bulkheads; and having a catamaran configuration in which the outrigger float of a first boat float comprises a second, identical, folding boat in which the rigid transverse cantelever beam is disposed in the transverse channel between the bow and stern section bulkheads when both boats are in their extended configurations, said beam being retained in said channel by screw fasteners through the respective bulkheads, and wherein said first and second boats are further supported in a parallel configuration by a second rigid transverse beam attached to the stern sections with threaded fasteners engaged into threaded holes in the respective boat stern section gunwales.

17. A folding boat according to claim 16 in which a fabric panel is attached to the respective nearest gunwale of each boat, the first rigid centelever beam and the second rigid cantelever beam, said fabric panel forming a passenger-supporting platform.

* * * * *